United States Patent [19]

Greaves, Jr.

[11] 4,375,860

[45] Mar. 8, 1983

[54] UNDERGROUND TANK WITH VOID-ELIMINATING CRADLE

[75] Inventor: Gerald G. Greaves, Jr., Houston, Tex.

[73] Assignee: Owens-Corning Fiberglas Corporation, Toledo, Ohio

[21] Appl. No.: 248,132

[22] Filed: Mar. 30, 1981

[51] Int. Cl.[3] ..... B65D 8/04; B65D 8/08; B65D 88/06; B65D 90/00

[52] U.S. Cl. ..... 220/1 B; 220/18; 220/69; 220/71; 220/83; 220/902

[58] Field of Search ..... 220/18, 69, 71, 1 B, 220/83, 902; 248/146, 346; 52/169.1, 169.6, 247, 86

[56] References Cited

U.S. PATENT DOCUMENTS

| | | | |
|---|---|---|---|
| 3,394,841 | 7/1968 | Anderson | 220/71 |
| 3,650,501 | 3/1972 | Streb | 248/146 |
| 4,071,161 | 1/1978 | Gilbu | 220/18 |
| 4,147,269 | 4/1979 | Werts | 220/1 B |
| 4,190,159 | 2/1980 | Hoyt | 220/444 X |

FOREIGN PATENT DOCUMENTS

| | | | |
|---|---|---|---|
| 2363471 | 6/1975 | Fed. Rep. of Germany | 220/69 |
| 2856442 | 7/1980 | Fed. Rep. of Germany | 220/444 |
| 858013 | 11/1940 | France | 248/146 |
| 908009 | 10/1962 | United Kingdom | 220/18 |

*Primary Examiner*—Allan N. Shoap

*Attorney, Agent, or Firm*—Ronald C. Hudgens; Kenneth H. Wetmore; Paul J. Rose

[57] ABSTRACT

Voids beneath a cylindrical underground tank are eliminated by providing a cradle for the tank which fills the space beneath the tank which would otherwise have to be filled with dirt, sand, or gravel.

3 Claims, 8 Drawing Figures

UNDERGROUND TANK WITH VOID-ELIMINATING CRADLE

TECHNICAL FIELD

This invention relates generally to underground tanks, and more particularly to a glass fiber reinforced plastic underground tank having a cradle for eliminating voids therebeneath.

BACKGROUND ART

Cylindrical glass fiber reinforced plastic underground tanks are non-corrosive and generally longlived, but occasionally failures occur due to improper installation. A proper installation requires that there be no voids beneath the tank and that the backfill material be properly compacted. Pea gravel is the preferred backfill material, with sand being the next best choice. Not all contractors follow the recommended installation procedures, and voids still occur under a tank, with the possibility of causing subsequent failure.

DISCLOSURE OF INVENTION

In accordance with the invention, a cradle is provided for the bottom of the tank. Preferably, the cradle includes a molded, glass fiber reinforced plastic casing or skin secured to the tank and plastic foam foamed in place between the tank and the casing. The sides of the casing are inclined at an angle of about forty-five degrees.

BRIEF DESCRIPTION OF DRAWINGS

The invention is hereinafter described in detail with reference to the accompanying drawings in which.

BEST MODE OF CARRYING OUT THE INVENTION

Figure 1:
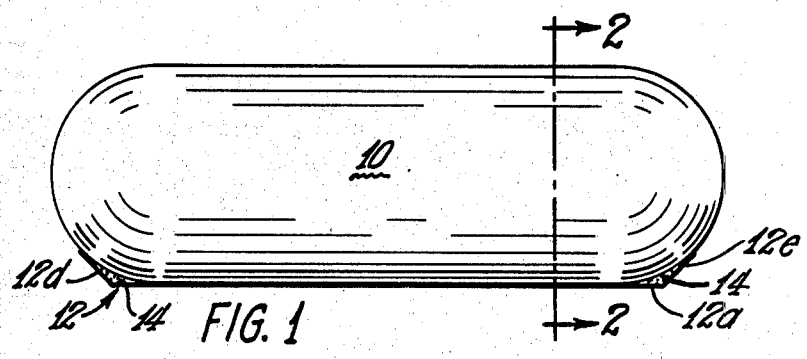
FIG. 1 is a side elevational view, partially in section, of a tank and cradle constructed in accordance with the invention.
Figure 2:
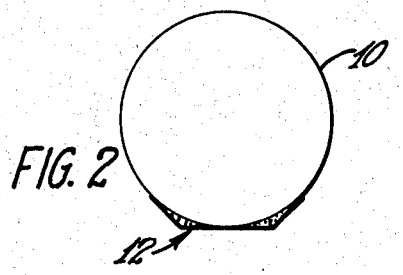
FIG. 2 is a sectional view taken along the line 2—2 of FIG. 1.
Figure 3:
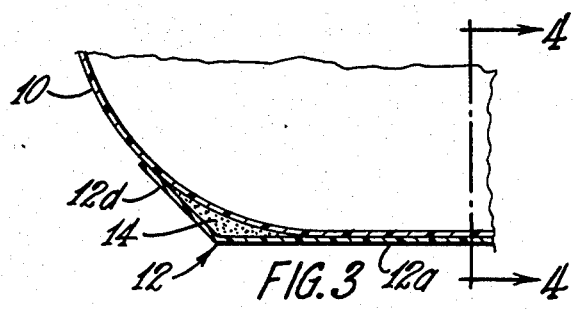
FIG. 3 is an enlarged fragmentary sectional view showing the lower left-hand portion of FIG. 1, but with the tank also in section.
Figure 4:
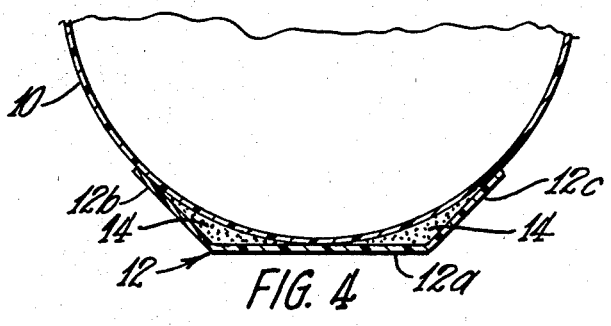
FIG. 4 is a fragmentary sectional view taken along the line 4—4 of FIG. 3.
Figure 5:
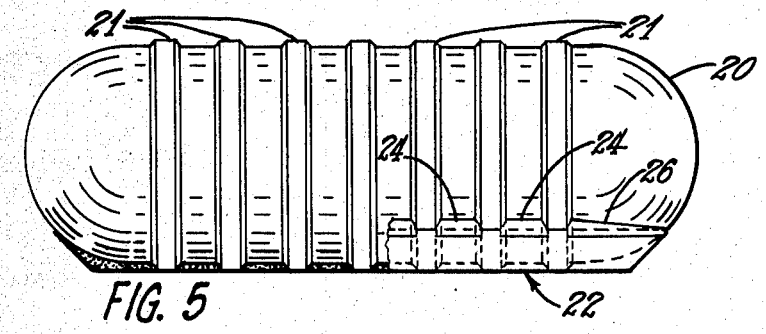
FIG. 5 is a side elevational view, partially in section, of a modified embodiment of the invention wherein the tank is provided with circumferential ribs.
Figure 6:
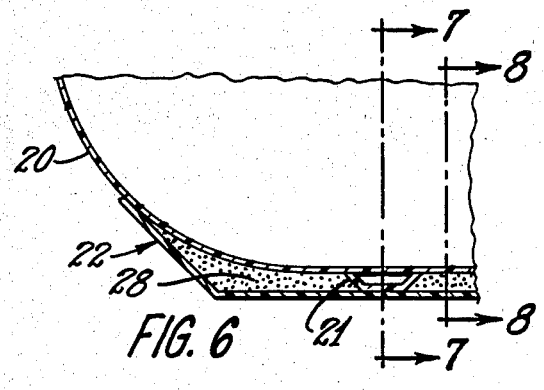
FIG. 6 is an enlarged fragmentary sectional view showing the lower left-hand portion of FIG. 5, but with the tank also in section.
Figure 7:
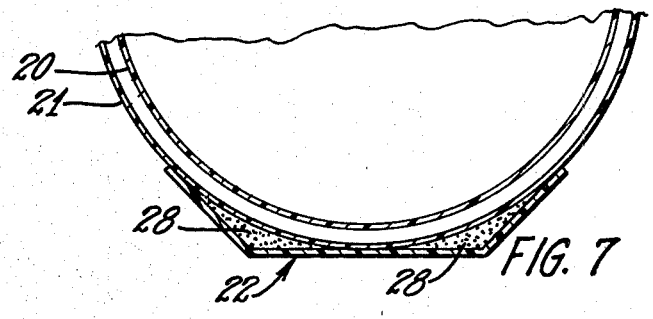
FIG. 7 is a fragmentary sectional view taken along the line 7—7 of FIG. 6.
Figure 8:
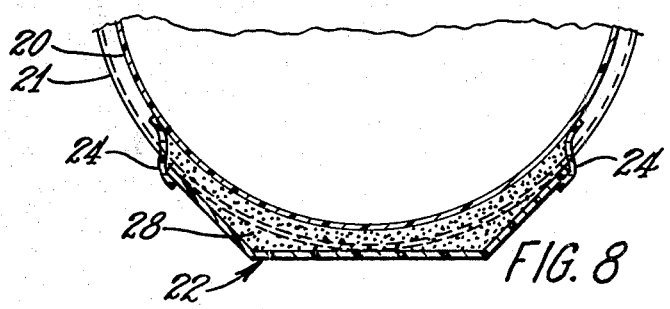
FIG. 8 is a fragmentary sectional view taken along the line 8—8 of FIG. 6.

With respect to the drawings, FIGS. 1 to 4 show a cylindrical tank 10 made of glass fiber reinforced plastic and having a trough-like casing 12, also formed of glass fiber reinforced plastic, adhesively secured to the bottom thereof. The casing 12 is trapezoidal in cross section, as shown in FIGS. 2 and 4, and includes a bottom portion 12*a* and a pair of inclined side portions 12*b* and 12*c*. As will be understood, the bottom portion 12*a* is oval-shaped and the side portions 12*b* and 12*c* are connected at opposite ends of the tank 10 by conical portions 12*d* and 12*e*. The casing 12 may be secured to the tank 10 by resin spray-up, a resin solvent, or an epoxy adhesive. The side portions 12*b* and 12*c* are upwardly divergent, tangent to the tank 10, and inclined to the horizontal at about forty-five degrees, which is at least as great as the forty-degree natural angle of repose of sand or gravel. The space between the tank 10 and the casing 12 is supplied with foamable liquid resin 14 which foams in place to form a cradle for the tank. When the tank 10 with the casing 12 attached is installed underground, the casing 12 and foam 14 fill the space under the tank where voids could otherwise possibly occur and eventually cause tank failure.

FIGS. 5 to 8 show a cylindrical tank 20 made of glass fiber reinforced plastic and provided with a plurality of conventional longitudinally spaced, circumferential ribs 21. A trough-like casing 22, also formed of glass fiber reinforced plastic, is adhesively secured to the bottom of the tank 20. The casing 22 is similar to the casing 12, but if the tanks 10 and 20 are the same size, as shown, the casing 22 will be larger than the casing 12, to accommodate the ribs 21. Therefore, resin spray-up portions 24 (FIGS. 5 and 8) are provided between each pair of adjacent ribs 21 to close the respective openings between the tank 20 and the casing 22. Each resin spray-up portion 24 may be formed by placing a piece of glass mat in position and spraying resin over it. Similarly, resin spray-up portions 26 (FIG. 5) are provided to close the respective openings between the ends of the tank 20 and conical end portions of the casing 22. The space between the tank 20 and the casing 22 is filled with foamable liquid 28 which foams in place.

Various modifications may be made in the structure shown and described without departing from the scope of the invention. It is within the scope of the invention to dispense with the casing 12 or 22 and form either of the foam portions 14 and 28 separately in a mold. The inventive concept is the elimination of voids beneath a cylindrical underground tank by the pre-filling of the space beneath the tank which would otherwise have to be filled with dirt, sand, or gravel, this space being defined in a cross section of the tank essentially by a horizontal bottom plane tangent to the bottom of the tank and two upwardly divergent planes extending upwardly therefrom respectively at angles of about forty-five degrees with respect thereto and tangent to the tank respectively on opposite sides of a longitudinal axis of the tank.

I claim:

1. A glass fiber reinforced plastic tank including an elongated generally cylindrical body portion and a pair of end cap portions respectively closing opposite ends of the body portion, the tank being adapted to be installed underground with a longitudinal axis of the body portion extending horizontally, and void-eliminating means preventing voids beneath the tank when the tank is installed in an excavated cavity in the ground and the cavity is backfilled, said void-eliminating means comprising hardened plastic foam filling the spaces generally defined by (a) an outer surface of a lower portion of the body portion of the tank, the outer surface extending substantially the full length of the body portion between the end cap portions, (b) a horizontal plane tangent to the bottom of the tank and extending substantially the full length of the body portion, and (c) a pair of planes diverging upwardly from the horizontal plane into tangency with the body portion of the tank respectively on opposite sides of a longitudinal axis thereof and extending substantially the full length of the body portion, a glass fiber reinforced plastic casing for the hardened plastic foam, the casing being generally defined by said planes and secured to the tank at the tangency of the upwardly diverging planes with the body portion thereof, said foam being provided in the spaces between the bottom horizontal plane tanqent and the tangency of the upwardly diverging planes.

2. The tank and void-eliminating means of claim 1 wherein the tank has external ribs to which said planes are tangent.

3. The combination of any of claim 1 or 2 wherein the upwardly divergent planes are inclined from the horizontal plane respectively at angles of about forty-five degrees.

* * * * *